United States Patent [19]

Liu

[11] Patent Number: 4,984,569

[45] Date of Patent: Jan. 15, 1991

[54] MASSAGING APPARATUS

[76] Inventor: Ten-An Liu, No. 44, Long-Hwa Street, Shou-Kung District, Kaohsiung, Taiwan

[21] Appl. No.: 523,904

[22] Filed: May 16, 1990

[51] Int. Cl.[5] ..... A61H 15/00

[52] U.S. Cl. ..... 128/57; 128/48; 128/49; 128/60

[58] Field of Search ..... 128/56, 55, 49, 52, 128/33, 48, 60, 57

[56] References Cited

U.S. PATENT DOCUMENTS

| | | | |
|---|---|---|---|
| 1,303,475 | 5/1919 | Hardy et al. | 128/49 |
| 2,306,424 | 11/1938 | Betz | 128/60 |
| 2,521,874 | 9/1950 | Runstedler | 128/49 |
| 2,534,412 | 12/1950 | Burnett et al. | 128/49 |
| 4,782,823 | 11/1988 | Yamasaki | 128/57 |

*Primary Examiner*—Edgar S. Burr
*Assistant Examiner*—Eric P. Raciti
*Attorney, Agent, or Firm*—Bacon & Thomas

[57] ABSTRACT

A massaging apparatus comprises a drum eccentrically and rotatably mounted on a supporting frame, a motor adapted for driving the drum to rotate, the drum supporting, between its two flanges, a plurality of evenly distributed eccentrically rotatable shafts, each shaft being integrally provided with a plurality of ridges. These ridges are axially staggered from one shaft to both adjacent shafts by reversely arranging the shafts on the drum. A cover for housing the supporting frame having an opening for exposing continuously an upper portion and a side portion of the drum to a user and a top plate horizontally disposed and extending substantially tangentially towards the drum.

5 Claims, 3 Drawing Sheets

MASSAGING APPARATUS

BACKGROUND OF THE INVENTION

This invention relates to a massaging device, and more particularly to an eccentrically rotary massageing machine which performs the function of massaging the required part of the human body.

U.S. Pat. No. 4,127,116 to Henri Pannetier teaches a massaging apparatus having two drums set angularly to each other and rotating in opposite directions under the action of motor means so that the tangential speeds on the side of the apparatus engaging the tissues are directed towards each other, said drums supporting a plurality of evenly distributed fixed or rotatable shafts each of which supports a sucession of pads respectively free or fixed to the shaft. These pads are axially staggered in the same direction from one shaft to another adjacent shaft in the rotating direction of the drum thus capable of effecting deep massage without nipping the tissues raised up between the two rotary drums, and also such that the tissues are not raised up simultaneously over the whole length of the apparatus.

This apparatus should be light in weight as it is designed for manual operation. Otherwise, the operator during self-treatment wound not be fully relaxed.

SUMMARY OF THE INVENTION

A primary object of this invention is to provide an improved massaging apparatus which can be stably positioned on a supporting surface for massaging the user's soles of feet or other required part of his body in an easy, comfortable and relaxing way.

Another object of this invention is to provide an eccentrically rotating massaging apparatus which possesses increased massage capabilities. Over the prior art.

With the above objectives in view, a massaging apparatus according to this invention comprises a drum eccentrically and rotatably mounted on a supporting frame, a driving means adapted for driving said drum to rotate, said drum supporting, between its two flanges, a plurality of evenly distributed eccentrically rotatable shafts, each shaft being integrally provided with a plurality of ridges. These ridges are axially staggered from one shaft to both adjacent shafts by reversely arranging the shafts on the drum. A cover means for housing said supporting frame having an opening for exposing continuously an upper portion and a side portion of the drum to an user and a top plate horizontally disposed and extending substantially tangentially towards the drum.

BRIEF DESCRIPTION OF THE DRAWINGS

FIG. 4A is a side elevational view of the rotary shaft shown in FIG. 4;

DETAILED DESCRIPTION OF THE PREFERRED EMBODIMENT

Figure 1:
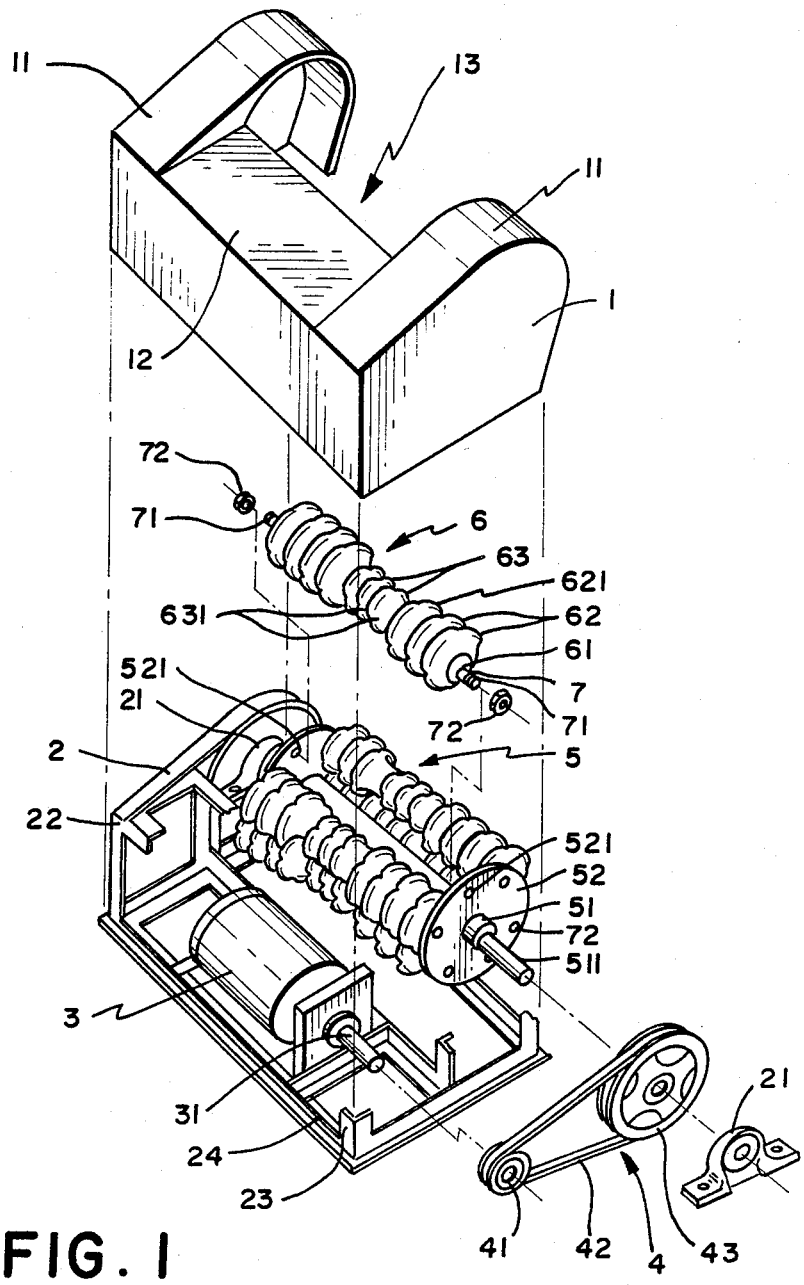
FIG. 1 is an exploded perspective view of the massaging apparatus according to this invention.
Figure 2:
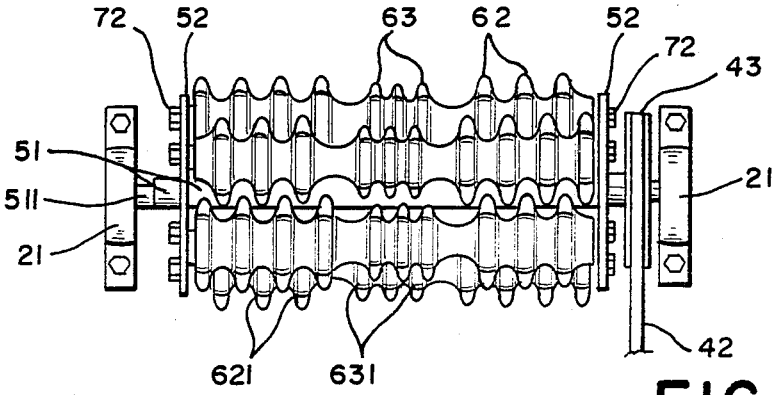
FIG. 2 is a front elevational view of a drum to be employed in this invention.
Figure 3:
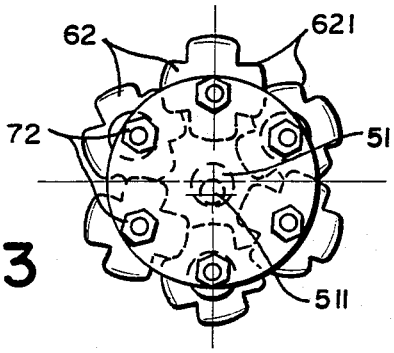
FIG. 3 is a side elevational view of the drum shown in FIG. 2.

Referring now to FIGS. 1, 2 & 3, the massaging apparatus according to this invention which mainly comprises a supporting frame 2 for eccentrically rotatably mounting a drum 5 and fitting an electric motor 3 side by side, said drum 5 being driven to rotate by the electric motor 3 through a transmission device 4, and a casing 1 substantially corresponding in shape to the supporting frame 2 for housing the supporting frame 2, the drum 5, electric motor 3 and transmission device 4 being mounted therein and formed with an opening 13 extending from a front part of top to front side of the casing 1 for exposing the drum 5 upwardly and frontwardly to the user to be treated.

The support frame 2 includes a pair of opposite side frames 22, 23 upraised from opposite sides of a base 24, on which the electric motor 3 is disposed, for mounting respectively and fixedly two bearings 21, The drum 5 comprises two flanges 52 between which are disposed a plurality of shafts 6 evenly spaced circumferentially on the flanges 52. Each flange 52 is coaxially formed with a cylindrical projection 51 which is further provided eccentrically with a rotating shaft 511 extending axially and mounted in a corresponding bearing 21. The electric motor 3 has an output shaft 31 on which a driving pulley 41 is mounted. Said driving belt 42 which passes round a second pulley 43 rotates with the shaft 511 of the drum 5.

Figure 4:
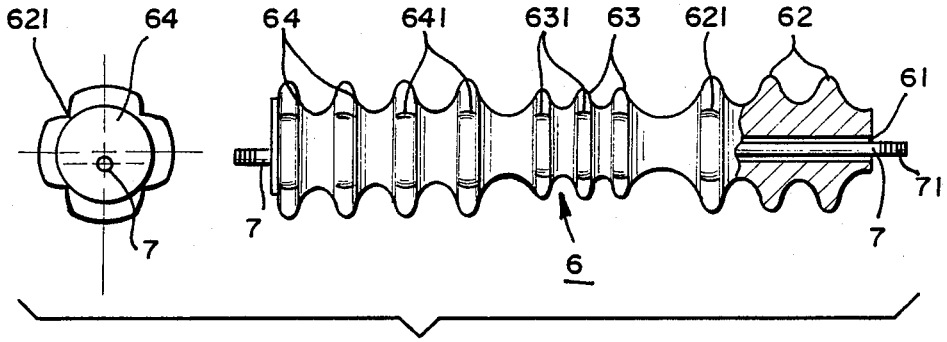
FIG. 4 is a front elevational view of a rotary shaft, which is partially sectioned and mounted on an axis, to be employed in this invention.

As best shown in FIGS. 4 and 4A, each shaft 6 is provided integrally with a first series of implements having three indentical ridges 63 and located on its middle portion, a second series of implements having three ridges 62 and located on one of its end portions, and a third series of implements having four indentical ridges 64 and located on its another end portion. Diameters of the ridges 62, 64 of both of the second and third implements are the same while diameter of the first series are smaller than that of both of the second and third implements. Each ridge 62, 63 or 64 is disposed coaxially on and perpendicularly to the shaft 6 and is eccentrically formed with a passage 61 extending axially therethrough for loosely receiving an axis 7 with two threaded ends 71 protruding therefrom. Also, each ridge 62, 63 or 64 is formed with notches 621, 631 or 641 which are equally spaced about the circumference thereof for increasing massaging capabilities. Said shafts 6 may be constructed from any one of a number of well known materials, such as wood, plastic and ceramic. It is preferred, however, that the drum 5 be sufficiently rigid such that the shafts 6 will not deform upon the application of pressure during normal use.

By so doing, the shaft 6 is rotatably mounted eccentrically on the axis 7 of which the two threaded ends 71 extend through and protrude from a pair of opposite holes 521 formed in outer portion of the flanges 52 respectively for being locked with nuts 72.

To obtain an even distribution of the drum 5, the number of shafts 6 mounted therein is even and preferably is six in amount, as shown in FIG. 3. From one shaft 6 to any other adjacent shaft 6, the ridges 62, 63 and 64 are axially staggered by sequentially arranging one shaft 6 reversely to any of its adjacent shafts 6.

The casing 1 comprises two side covers 11 extending frontwardly and slightly upwardly, then downwardly and slightly inwardly through a curved portion. Said side covers 11 are secured to both sides of a stepping plate 12 which extends substantially tangentially relative to the drum 5 when mounting the casing 1 on the supporting frame 2 and coacting with the side covers 11 to define the opening 13.

Figure 5:
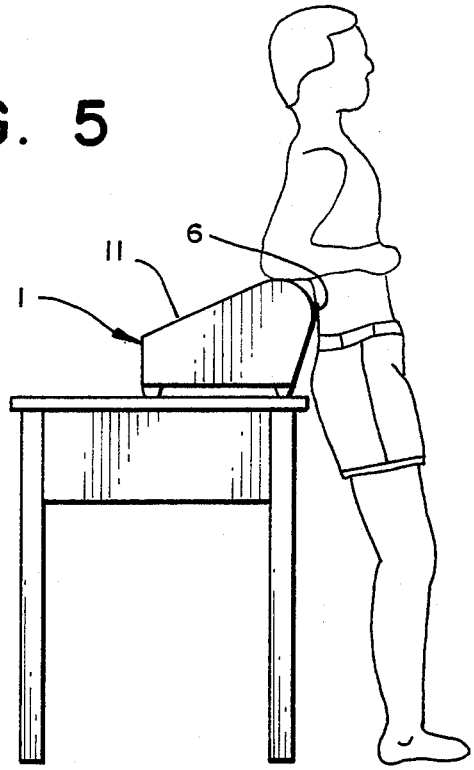
FIG. 5 is a diagramatic illustration showing a state of the massaging apparatus of this invention in treating a human's back.

In operation of the massaging apparatus, the electric motor 3 is firstly started to drive the drum 5 to rotate by turning on a control switch. The rotating drum 5 defines circumferentially three treating portions including two symmetric side treating portions and a middle treating portion formed by the three series of implements 62, 63 and 64. As shown in FIG. 5, the massaging apparatus 1 can be placed on a table at a proper height and one, of whom the back needs to be treated, stands in front of the apparatus and table with his elbows resting on the curved positions of side covers 11 and his back abutting against the shafts 6 of the drum and thus be treated. The user can adjust his attitude, high or low, at his free will so as to treat his back in a relatively wide range in a relaxing and comfortable way.

Figure 6:
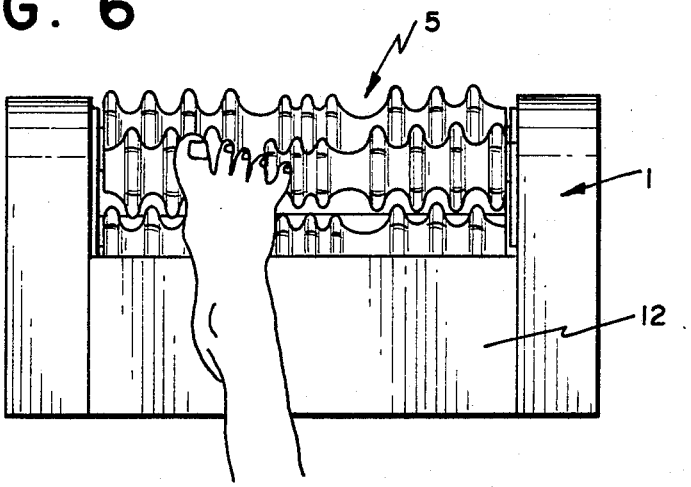
FIG. 6 is a diagramatic illustration showing a state of the massaging apparatus of this invention in treating human's sole of a foot.

As shown in FIG. 6, the massaging apparatus 1 can be placed on a floor and one, of whom the sole of his foot or soles of his feet wants to be treated, sits on a chair which is positioned in rear of the apparatus with his heel resting on the stepping plate 12 and the rest of his sole abutting against the rotating drum 5 and thus be treated. The user can shift his sole among the three treating portions for selecting deep treatment (actuated by side treating portions) or light treatment (actuated by middle treating portion) solely or alternately during his treating procedure. Two soles of his feet or other extremities such as hands can also be simultaneously by abutting against the rotating drum 5 in a way similar to one sole treatment described above.

While a representative embodiment and details has been shown for the purpose of illustrating the invention, it will be apparent to those skilled in this art that various changes and modifications may be made therein without departing from the spirit or scope of the invention.

What is claimed is:

1. A massaging apparatus comprising: a supporting frame;

a driving means including an electric motor mounted on the supporting frame and a transmission device;

a drum rotatably and eccentrically mounted to the supporting frame and adapted to be driven by said driving means, said drum including:

(i) two flanges spaced apart from each other;

(ii) a plurality of shafts evenly fitted between two flanges and spaced at equal intervals about the circumference thereof;

(iii) a plurality of ridges coaxially and integrally formed on the shafts; and a cover means for housing the supporting frame having a pair of symmetric side covers for housing side portions of the supporting frame and a horizontal top plate extending substantially tangentially towards the drum and interconnecting the side covers, said top plate coacting with the side covers to define an opening which exposes continously an upper portion adjacent to the top plate of the cover means and a side portion to an user to be treated.

2. A massaging apparatus as claimed in claim 1 wherein each shaft of the drum is eccentrically formed with a passage extending axially therethrough for eccentrically and rotatably mounting the shaft on an axis of which two ends are secured to opposite and outer portions of the two flanges.

3. A massaging apparatus as claimed in claim 1 wherein the number of the shafts in the drum is even.

4. A massaging apparatus as claimed in claim 3 wherein each shaft is provided with at least two series of ridges which are the same in diameter and located in side portions in equal intervals along the axial direction of the shaft, the number of ridges in a first series of ridges is one more than the number of ridges in a second series of ridges and the shafts of the drum are arranged such that any one of said shafts is adjacents to, along the periphery of said flanges, another one of said shafts having a different one of said series of ridges than itself, whereon the ridges are axially staggered.

5. A massaging apparatus as claimed in claim 4 whereineach shaft is further provided with a third series of ridges which locate in a middle portion of the shaft in equal intervals along the axial direction and are smaller in diameter than the ridges of the first and second series.

* * * * *